US009089886B2

(12) United States Patent
Levinski

(10) Patent No.: US 9,089,886 B2
(45) Date of Patent: Jul. 28, 2015

(54) METHOD OF TREATING A METAL ELEMENT FOR AN AUTOMOBILE

(75) Inventor: Leonid Levinski, Diegem (BE)

(73) Assignee: THERMISSION AG, Engelberg/OW (CH)

( * ) Notice: Subject to any disclaimer, the term of this patent is extended or adjusted under 35 U.S.C. 154(b) by 839 days.

(21) Appl. No.: 13/241,241

(22) Filed: Sep. 23, 2011

(65) Prior Publication Data

US 2013/0074560 A1 Mar. 28, 2013

(51) Int. Cl.

| | |
|---|---|
| ***B21C 43/04*** | (2006.01) |
| ***C23G 1/02*** | (2006.01) |
| ***B21D 35/00*** | (2006.01) |

(52) U.S. Cl.

CPC ..... *B21C 43/04* (2013.01); *B21D 35/008* (2013.01); *C23G 1/02* (2013.01)

(58) Field of Classification Search

CPC ..... C23G 1/02; C21D 1/18; C21D 1/58; C21D 2241/00; B21D 31/06; B21D 35/008; B21C 43/00; B21C 43/04

USPC ..... 72/39, 40, 47, 342.2, 342.5; 148/636, 148/637, 638; 134/3

See application file for complete search history.

(56) References Cited

U.S. PATENT DOCUMENTS

| | | | | |
|---|---|---|---|---|
| 3,668,917 | A * | 6/1972 | Komatsu et al. | 72/342.3 |
| 4,401,479 | A | 8/1983 | Quick | |
| 6,277,799 | B1 | 8/2001 | Sachdev et al. | |
| 6,585,826 | B2 * | 7/2003 | Tai et al. | 134/3 |
| 2002/0197491 | A1 | 12/2002 | Rocks | |
| 2006/0131185 | A1 | 6/2006 | Lev et al. | |
| 2006/0137779 | A1 | 6/2006 | Brodt et al. | |
| 2006/0219334 | A1 | 10/2006 | Brodt et al. | |
| 2008/0202550 | A1 | 8/2008 | McDermott et al. | |
| 2009/0211669 | A1 * | 8/2009 | Vehof | 148/654 |

FOREIGN PATENT DOCUMENTS

| | | | | |
|---|---|---|---|---|
| JP | 2005-28408 A * | 2/2005 | | B23K 11/30 |
| JP | 2008 222823 A | 9/2008 | | |

* cited by examiner

*Primary Examiner* — Edward Tolan

(74) *Attorney, Agent, or Firm* — Norman B. Thot

(57) ABSTRACT

A method for treating a metal element for an automobile includes hardening the metal element so as to obtain a press hardened metal element. Scale from the press hardened metal element are removed by placing the press hardened metal element in an ultrasonic liquid and preforming an ultrasonic process thereon so as to obtain a de-scaled press hardened metal element. The ultrasonic liquid is an aqueous solution comprising an organic carboxylic acid in a concentration of from 0.1 to 10 vol.-%. The de-scaled press hardened metal element is coated in a coating process with an anti-corrosion coating.

15 Claims, No Drawings

METHOD OF TREATING A METAL ELEMENT FOR AN AUTOMOBILE

FIELD

The present invention provides a method for treating a metal element for an automobile.

BACKGROUND

A metal element component of an automobile body or an automobile frame can be made from a metal sheet and/or a massive metal element of the automobile, such as a bolt, a spring or another massive component not made of a metal sheet. The metal element must exhibit high strength and good anti-corrosive qualities.

For increasing the metal element strength, the metal element can be heated in an oven to a temperature of 550° C. to 1200° C., and subsequently quickly cooled down to a temperature below 220° C. in an oil bath or by cooled air. In a so called "press-hardening process", the metal element is heated to a temperature of 800° C. to 1000° C. and is formed into its end shape by pressing and then cooled in a press subsequent to the heating. The hardened metal element has a very high strength and can be used to produce relatively light metal elements for an automobile. Subsequent to the hardening, the hardened high strength metal element is made anti-corrosive by means of a surface treatment or a surface coating step.

On the way from the hardening oven to the oil bath or to the press, the heated metal element is, because the high temperature difference with the environment, subject to scaling so that the scale must be removed from the metal element before the metal element is passed to the surface treatment or surface coating step. A method for scale removing is pickling in a cleaning liquid with a strong acid, for example, with sulphuric acid. With this scale removing method, even the smallest structures, such as slits, hollow spaces, undercuts etc. are removed. Use of a strong acid has the disadvantage, however, that the treated high strength metal element becomes brittle. An alternative method for scale removing is shot blasting which does not affect the inner structure of the metal element but is not suitable to remove scale from small structures, slits, undercuts etc. Shot blasting stream also has the disadvantage that it can mechanically deform a sheet-made metal element.

SUMMARY

An aspect of the present invention is to improve the scale removing from an automobile metal element between the hardening step and the subsequent coating step.

In an embodiment, the present invention provides a method for treating a metal element for an automobile which includes hardening the metal element so as to obtain a press hardened metal element. Scale from the press hardened metal element is removed by placing the press hardened metal element in an ultrasonic liquid and preforming an ultrasonic process thereon so as to obtain a de-scaled press hardened metal element. The ultrasonic liquid is an aqueous solution comprising an organic carboxylic acid in a concentration of from 0.1 to 10 vol.-%. The de-scaled press hardened metal element is coated in a coating process with an anti-corrosion coating.

DETAILED DESCRIPTION

In an embodiment of the present invention, the metal element is first hardened. The hardening step can be accomplished by heating the metal element in an oven to a temperature of about 550° C. to 1200° C. After heating, the metal element is quickly cooled down to a temperature of below 200° C. in an oil bath or by cooled air. On the way from the heating oven to the oil bath or to a press for providing a press-hardening step, the metal element is subject to scaling.

Subsequent to the hardening step, a scale removing step is provided by an ultrasonic process, whereby the ultrasonic liquid is a water solution with an organic carboxylic with a concentration of between 0.1 to 10 vol.-%.

Experiments have shown that such a water solution does not significantly affect the metal elements surface and does not make the metal element brittle. On the other hand, the ultrasonic cleaning method provides that the scale is completely removed even from small structures, slits, hollow spaces, undercuts etc.

Subsequent to the scale removing step, the metal element can be coated in a coating process with an anticorrosion coating. This coating process can be realized, for example, by a so-called thermal diffusion process with, for example, zinc powder.

In an embodiment of the present invention, the organic carboxylic acid concentration can be between about 1.0 and 6.0 vol.-%, for example, between about 2.0 and 6.0 vol.-%. In an embodiment of the present invention, the organic carboxylic acid can be citric acid.

The ultrasonic liquid can, for example, have a pH value of between about 3.0 and 5.0.

In an embodiment of the present invention, the ultrasonic frequency during the ultrasonic cleaning sequence is between about 18 kHz and 60 kHz, whereby the ultrasonic frequency can be a varied/modified during a part of and/or during the entire ultrasonic scale removing sequence. The ultrasonic activity can, for example, be provided in intervals with numerous interruptions of less than 30% during the ultrasonic process step. The scale removing sequence can take between about one and eight minutes.

The temperature of the ultrasonic liquid can, for example, be between about 30 and 70° C. The ultrasonic liquid is very effective in this temperature range.

In an embodiment of the present invention, the metal element can be moved with respect to the ultrasonic liquid during the ultrasonic cleaning sequence. The metal element can, for example, be rotated in the ultrasonic liquid during the ultrasonic treatment. The metal element can, for example, be rotated by a rotor in the ultrasonic liquid during the ultrasonic treatment. The rotor holds the metal element in a rotor cradle or with rotor fingers attached to the metal element.

The metal element can, for example, be a complex structural automobile element.

The following is a description of one embodiment of the method according to the present invention.

A metal element to be treated can be any metal automobile component which must have high strength and good anticorrosive qualities. Examples of parts which can be treated pursuant to the method of the present invention include automobile components made out of thin metal sheets as well as massive parts such as springs and bolts. The following example refers to a sheet-like metal element which is formed to a component of the automobile body or automobile frame.

In a hardening step, the metal sheet element is transferred to a hardening oven wherein the metal sheet element is heated to a temperature of 700° C. to 1000° C. in an oven, and is subsequently formed into its end shape by pressing under high pressure in a press-hardening press. As soon as the heated metal sheet element is removed from the oven, the metal sheet element is subject to scaling on the way to the press so that the metal sheet element is covered with a layer of scale after leaving the press-hardening oven. After the press-hardening step in the press, the press is opened, and the metal sheet element is removed from the press.

Before the metal sheet element is transferred to a coating step for coating the high strength metal sheet element with an anticorrosion coating, the scale layer must be removed from the metal sheet element.

The scale removing step is carried out in a scale removing device, wherein the high strength metal sheet element is fixed to a rotor which rotates the metal sheet element in an ultrasonic liquid. The ultrasonic liquid is a water solution with an organic carboxylic acid with a concentration of about 4.0 vol.-%. The acid can, for example, be a citric acid. The ultrasonic liquid can have a temperature of about 50° C. and a pH value of about 4.

The scale removing process starts as soon as the metal sheet element is fixed to the rotor and immersed into the ultrasonic liquid: an ultrasonic device induces ultrasonic waves into the ultrasonic liquid. The frequency of the ultrasonic waves varies between about 20 kHz and 40 kHz, and can be provided in intervals of, for example, 50 seconds, separated by interruptions of 10 seconds. The metal sheet element is rotated by the rotor in the ultrasonic liquid during the entire ultrasonic treatment step. The ultrasonic treatment of one metal sheet element takes a total of about 5 minutes.

After the scale removing step is completed, the metal sheet element is removed from the ultrasonic scale removing device, and is transferred to a coating process step whereby the metal sheet element is provided with an anticorrosion treatment by a so-called thermal diffusion process with zinc powder.

Although the present invention has been described and illustrated with reference to specific embodiments thereof, it is not intended that the present invention be limited to those illustrative embodiments. Those skilled in that art will recognize that variations and modifications can be made without departing from the true scope of the present invention as defined by the claims that follow. It is therefore intended to include within the present invention all such variations and modifications as fall within the scope of the appended claims and equivalents thereof.

What is claimed is:

1. A method for treating a metal element for an automobile, the method comprising:

hardening the metal element so as to obtain a press hardened metal element;

removing scale from the press hardened metal element by placing the press hardened metal element in an ultrasonic liquid and preforming an ultrasonic process thereon so as to obtain a de-scaled press hardened metal element, wherein the ultrasonic liquid is an aqueous solution comprising an organic carboxylic acid in a concentration of from 0.1 to 10 vol.-%, and the ultrasonic process comprises an ultrasonic frequency of between 18 kHz and 60 kHz; and coating the de-scaled press hardened metal element in a coating process with an anti-corrosion coating, wherein the ultrasonic frequency is varied/modified during a part of or during the entire ultrasonic process step.

2. The method as recited in claim 1, wherein the hardening is performed by press-hardening.

3. The method as recited in claim 1, wherein the concentration of the organic carboxylic acid is between 1.0 and 8.0 vol.-%.

4. The method as recited in claim 1, wherein the concentration of the organic carboxylic acid is between 2.0 and 6.0 vol.-%.

5. The method as recited in claim 1, wherein the organic carboxylic acid is a citric acid.

6. The method as recited in claim 1, wherein the ultrasonic liquid has a pH-value of between 3.0 and 5.0.

7. The method as recited in claim 1, wherein the ultrasonic process comprises an ultrasonic activity preformed in intervals with at least one interruption of less than 30% during the ultrasonic process step.

8. The method as recited in claim 1, wherein the removing takes from about 1 to 8 minutes.

9. The method as recited in claim 1, wherein the ultrasonic liquid has a temperature of from about +30 to +70° C.

10. The method as recited in claim 1, wherein the press hardened metal element is moved with respect to the ultrasonic liquid during the ultrasonic process.

11. The method as recited in claim 1, wherein the press hardened metal element is rotated in the ultrasonic liquid during the ultrasonic process.

12. The method as recited in claim 1, wherein the press hardened metal element is rotated by a rotor in the ultrasonic liquid during the ultrasonic process.

13. The method as recited in claim 1, wherein the metal element is a complex structural automobile element, and wherein the hardening is performed by a press-hardening.

14. The method as recited in claim 1, wherein the metal element is a massive element, and wherein the hardening is performed by heating and subsequently cooling in an oil bath.

15. The method as recited in claim 1, wherein the coating is performed with a thermal diffusion process using a zinc powder.

* * * * *